US008490710B2

(12) United States Patent
Archibald et al.

(10) Patent No.: US 8,490,710 B2
(45) Date of Patent: Jul. 23, 2013

(54) IN-COMPUTER FIRE SUPPRESSION

(75) Inventors: Matthew R. Archibald, Morrisville, NC (US); Jerrod K. Buterbaugh, Wake Forest, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 13/482,327

(22) Filed: May 29, 2012

(65) Prior Publication Data

US 2012/0234563 A1 Sep. 20, 2012

Related U.S. Application Data

(63) Continuation of application No. 12/777,592, filed on May 11, 2010.

(51) Int. Cl.
*A62C 2/00* (2006.01)

(52) U.S. Cl.
USPC ..... 169/46; 169/9; 169/11; 169/45; 169/47; 169/49; 169/56; 169/61; 169/70; 169/71; 340/289; 340/693.6

(58) Field of Classification Search
USPC ..... 169/9, 11, 19, 26, 30, 49, 54, 56, 169/60, 61, 71, 45–47; 340/289, 578, 693.5, 340/693.6
See application file for complete search history.

(56) References Cited

U.S. PATENT DOCUMENTS

| | | | | |
|---|---|---|---|---|
| 3,403,733 | A * | 10/1968 | Terry | 169/49 |
| 4,616,694 | A * | 10/1986 | Hsieh | 169/61 |
| 4,711,307 | A * | 12/1987 | Rosen | 169/26 |
| 5,636,755 | A | 6/1997 | Guiher | |
| 6,317,053 | B1 | 11/2001 | Seeliger et al. | |
| 2004/0132398 | A1 | 7/2004 | Sharp et al. | |
| 2007/0103325 | A1 * | 5/2007 | Wagner et al. | 340/628 |
| 2009/0211773 | A1 | 8/2009 | Gooch | |
| 2009/0216381 | A1 | 8/2009 | Gooch | |
| 2011/0278027 | A1 | 11/2011 | Archibald et al. | |

FOREIGN PATENT DOCUMENTS

| | | |
|---|---|---|
| JP | 2000-334059 | 12/2000 |
| JP | 2002-289262 | 10/2002 |
| JP | 2003-233883 | 8/2003 |
| JP | 2007-236445 | 9/2007 |

OTHER PUBLICATIONS

Salwan, "Data Center Fire Suppression", Consulting-Specifying Engineer, May 2008, pp. 16-18, vol. 43, No. 5, Chicago.

* cited by examiner

*Primary Examiner* — Steven J Ganey
(74) *Attorney, Agent, or Firm* — Brandon C. Kennedy; Cynthia G. Seal; Biggers & Ohanian, LLP

(57) ABSTRACT

In-computer fire suppression, the computer comprising an in-computer flame detector and an in-computer fire extinguisher including detecting, by an in-computer flame detector, a flame, releasing, by the in-computer fire extinguisher, an extinguishing agent in response to the flame detector detecting the flame; and disabling the power supply to the computer having within it the in-computer flame detector and the in-computer fire extinguisher.

9 Claims, 6 Drawing Sheets

IN-COMPUTER FIRE SUPPRESSION

CROSS-REFERENCE TO RELATED APPLICATION

This application is a continuation application of and claims priority from U.S. patent application Ser. No. 12/777,592, filed on May 11, 2010.

BACKGROUND OF THE INVENTION

1. Field of the Invention

The field of the invention is fire suppression, or, more specifically, methods, apparatus, and products for in-computer fire suppression.

2. Description of Related Art

The development of the EDVAC computer system of 1948 is often cited as the beginning of the computer era. Since that time, computer systems have evolved into extremely complicated devices. Today's computers are much more sophisticated than early systems such as the EDVAC. Computer systems typically include a combination of hardware and software components, application programs, operating systems, processors, buses, memory, input/output devices, and so on. As advances in semiconductor processing and computer architecture push the performance of the computer higher and higher, more sophisticated computer software has evolved to take advantage of the higher performance of the hardware, resulting in computer systems today that are much more powerful than just a few years ago.

Computers often short circuit causing small fires in the computer. In the event of a high impedance short circuit inside a server or other computer, the power supply over-current detection may not function properly. Since the power supply doesn't detect such an over-current condition, the power supply continues to supply current. Depending on the location of the short on the system board, a fire can result until either the high impedance short opens completely or shorts completely, at which time the power supply over-current detection circuit shut the power supply down. Such small fires in a server or other computer often do not produce enough smoke to set off a smoke detector until the fire has spread to the point of endangering other servers and computers.

SUMMARY OF THE INVENTION

In-computer fire suppression including detecting, by an in-computer flame detector, a flame, releasing, by the in-computer fire extinguisher, an extinguishing agent in response to the flame detector detecting the flame; and disabling the power supply to the computer having within it the in-computer flame detector and the in-computer fire extinguisher.

The foregoing and other objects, features and advantages of the invention will be apparent from the following more particular descriptions of exemplary embodiments of the invention as illustrated in the accompanying drawings wherein like reference numbers generally represent like parts of exemplary embodiments of the invention.

DETAILED DESCRIPTION OF EXEMPLARY EMBODIMENTS

Figure 1:
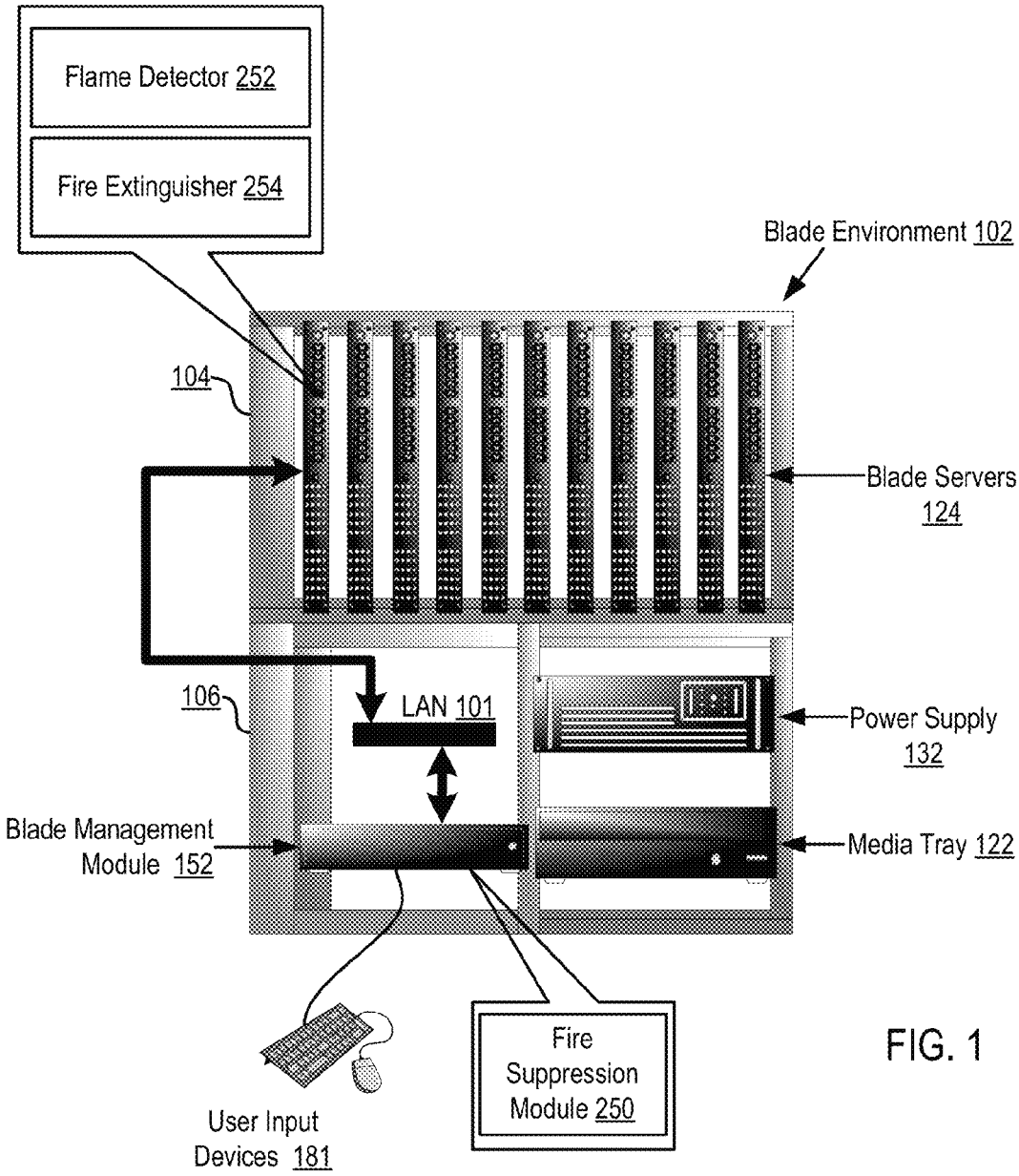
FIG. 1 sets forth a diagram of an example data processing system capable of in-computer fire suppression according to embodiments of the present invention.

Exemplary methods, apparatus, and products for in-computer fire suppression in accordance with the present invention are described with reference to the accompanying drawings, beginning with FIG. 1. FIG. 1 sets forth a diagram of an example data processing system capable of in-computer fire suppression according to embodiments of the present invention. The data processing system of FIG. 1 includes a blade environment (102). 'Blade environment,' as the term is used in this specification, refers generally to a blade server system installed in this example in a two-bay chassis (104, 106) and including a number of blade servers (124), one or more blade management modules (152), a media tray (122), and a blade server system power supply (132). 'In-computer' means within the case of a computer. That is, within an enclosure containing a computer. In a blade environment for example, each blade server has a case enclosing each blade server.

The blade management module (152) is a small computer in its own right, including software and hardware components, one or more computer processors and computer memory, that provides system management functions for all components in the example blade environment (102) including the blade servers (124) and the media tray (122). The blade management module of FIG. 1 also makes available connections for user input devices such as mice or keyboards (181) that are not generally connected directly to the blade servers or to the blade environment chassis. The blade servers themselves (124), installed in a cabinet bay (104) of the exemplary blade environment (102) in the example of FIG. 1, are several computing devices implemented in blade form factor. The blade servers share access to the media tray (122). The blade servers (124) are connected to one another and to the blade management module (152) for data communications through a local area network (LAN) (101). The LAN (101) is a small network installed within the chassis of the blade environment.

The media tray (122) houses non-volatile memory media generally. A media tray may typically include Compact Disc read-only media drives (CD-ROM), Digital Video Disc ROM drives (DVD-ROM), CD-RW drives, DVD-RW drives, floppy disk drives, and so on as will occur those of skill in the art.

Each of the blade servers (124) of FIG. 1 has installed within it a flame detector (252) and a fire extinguisher (254). A flame detector (252) is a sensor that detects flame. Flame detectors are typically optical sensors. There are a number of types of flame detectors useful for in-computer fire suppression according to embodiments of the present invention. Examples of flame detectors useful for in-computer fire suppression according to embodiments of the present invention include ultraviolet flame detectors, infrared flame detectors, combined ultraviolet-infrared flame detectors, dual infrared flame detectors, triple infrared flame detectors, visible radiation flame detectors and others as will occur to those of skill in the art.

Ultraviolet flame detectors typically sense wavelengths shorter than 300 nanometers. Ultraviolet detectors typically detect fires within 3-4 milliseconds due to the UV radiation emitted at the instant of their ignition.

Infrared flame detectors sense light within the infrared spectral band. Hot gases often emit a specific spectral pattern in the infrared region, which can be sensed with a thermal imaging camera (TIC) a type of thermographic camera. A typical frequency where single frequency infrared flame detectors are sensitive is in the 4.4 micrometer range.

Combined ultraviolet-infrared flame compare the threshold signal in both the ultraviolet range and the infrared range to minimize false alarms. Dual infrared flame detectors compare the threshold signal in two infrared ranges. Triple infrared flame detectors compare three specific wavelength bands within the infrared spectral region and use their ratio to each other to reliably detect flames and minimize false alarms. Visible radiation flame detectors sense visible radiation and are often used with other types of flame detectors in order to reduce false alarms and improve the detection range.

The examples of types of flame detectors useful for in-computer fire suppression according to embodiments of the present invention are provided for explanation and not for limitation. Other types of flame detectors may also be used for in-computer flame suppression as will occur to those of skill in the art and all such flame detectors are within the scope of the present invention.

A fire extinguisher (254) is a fire protection device used to extinguish or control fires. There are two main types of fire extinguishers: stored pressure unit fire extinguishers and cartridge-operated. In stored pressure unit fire extinguishers, an expellant is stored in the same chamber as the extinguishing agent itself. Depending on the extinguishing agent used, different propellants may be used. With dry chemical extinguishers, for example, nitrogen is often used; water and foam extinguishers typically use air as an expellant. Cartridge-operated fire extinguishers contain an expellant gas in a separate cartridge that is punctured prior to discharge, exposing the propellant to the extinguishing agent. Cartridge-operated extinguishers often use compressed carbon dioxide instead of nitrogen.

Fire extinguishers useful for in-computer fire suppression according to embodiments of the present invention may use different kinds of extinguishing agents. Such extinguishing agents are typically non-conducting and include dry chemical, chemical foam, and others as will occur to those of skill in the art. Examples of extinguishing agents for in-computer fire suppression according to embodiments of the present invention include dry chemical extinguishing agents such as ammonium phosphate, sodium bicarbonate, potassium bicarbonate, potassium chloride, and others; foam extinguishing agents such as aqueous film forming foam, alcohol resistant aqueous film forming forms, film forming fluoroprotein, compressed air form, and others as will occur to those of skill in the art; carbon dioxide extinguishing agents; Halon extinguishing agents such as Halon 1211 and 1301 and others; and other extinguishing agents as will occur to those of skill in the art.

The blade management module (152) of FIG. 1 has installed within it a fire suppression module (250). The fire suppression module (252) of FIG. 1 is a module of automated computing machinery that includes computer program instructions capable, when executed, of causing a computer to carry out the steps of receiving, from an in-computer flame detector (252) on one of the blade servers (124), a flame event; sending an instruction to an in-computer fire extinguisher (254) in that blade server to release an extinguishing agent; and disabling the power supply to the blade server in which the flame was detected.

A flame event is a notification from a flame detector that the flame detector has detected a flame in the computer in which the flame detector is installed. Such a flame event may be implemented as a message sent across a data communications network, a message implemented through the use of shared memory, or implemented as any other event notification that will occur to those of skill in the art. In embodiments where the flame detector is an infrared flame detector, the flame event may be a notification that light having wavelengths in a predetermined range of infrared light was detected. In embodiments where the flame detector is an ultraviolet flame detector, the flame event may be a notification that light having wavelengths in a predetermined range of ultraviolet light was detected. And so on as will occur to those of skill in the art.

As mentioned above, in response to receiving the flame event, the fire suppression module (250) sends an instruction to an in-computer fire extinguisher to release an extinguishing agent. Sending an instruction to an in-computer fire extinguisher to release an extinguishing agent in response to detecting the flame further may include sending an instruction to release a stored pressure unit containing the extinguishing agent. Sending an instruction to an in-computer fire extinguisher to release an extinguishing agent in response to detecting the flame may also include sending an instruction to puncture a cartridge containing the extinguishing agent.

The fire suppression module (252) of FIG. 1 also disables the power supply to the blade server in which the flame was detected. Disabling the power supply may be carried out by instructing a power management module to disable power to the blade server, by engaging a power supply disable pin, or in other ways as will occur to those of skill in the art.

In the example of FIG. 1, the fires suppression module (252) is described as a module of software. In alternative embodiments, fire suppression modules may be implemented in hardware or a combination of hardware and software as will occur to those of skill in the art.

The arrangement of the blade environment (102), network (101), and other devices making up the exemplary system illustrated in FIG. 1 are for explanation, not for limitation. Data processing systems useful according to various embodiments of the present invention for in-computer fire suppression may include additional servers, routers, and other devices, not shown in FIG. 1, as will occur to those of skill in the art. Networks in such data processing systems may support many data communications protocols, including for example TCP (Transmission Control Protocol), IP (Internet Protocol), HTTP (HyperText Transfer Protocol), WAP (Wireless Access Protocol), HDTP (Handheld Device Transport Protocol), and others as will occur to those of skill in the art. Various embodiments of the present invention may be implemented on a variety of hardware platforms in addition to those illustrated in FIG. 2.

Figure 2:
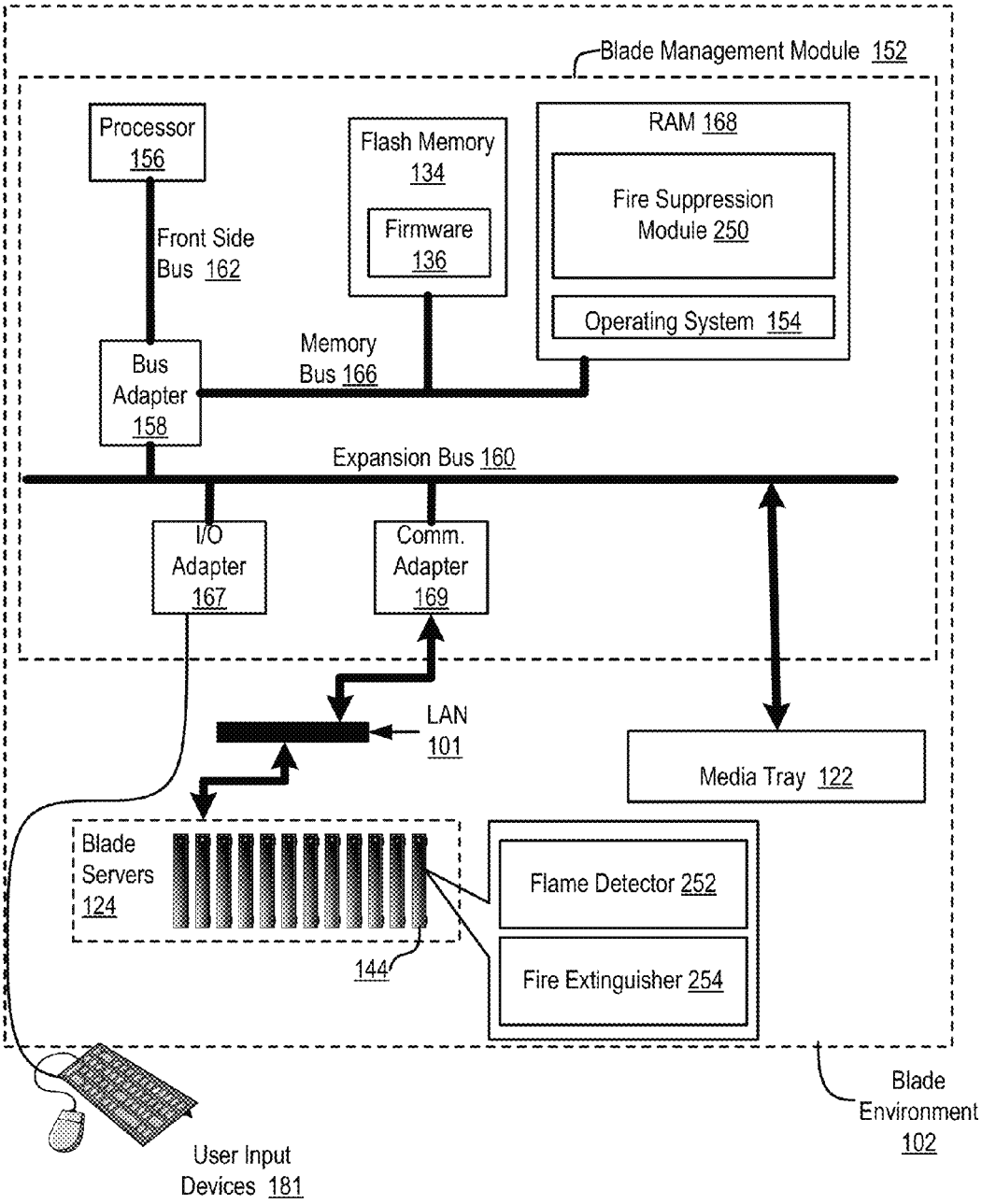
FIG. 2 sets forth a diagram of a further example data processing system capable of in-computer fire suppression according to embodiments of the present invention.

For further explanation, FIG. 2 sets forth a diagram of a further example data processing system capable of in-computer fire suppression according to embodiments of the present invention. The example data processing system of FIG. 2 is similar to the example of FIG. 1, including as it does a blade environment (102), blade servers (124) connected through an internal LAN (101) to a blade management module (152), a media tray (122) connected to the blade management module. In addition, however, in contrast with FIG. 1, FIG. 2 also includes a functional block diagram showing more detail of the blade management module (152). The blade management module (152) of FIG. 1 includes at least one computer processor (156) or 'CPU' as well as random access memory (168) ('RAM') which is connected through a high speed memory bus (166) and bus adapter (158) to processor (156) and to other components of the blade management module (152).

Stored in RAM in this example is a fire suppression module (250). The fire suppression module (252) of FIG. 1 is a module of automated computing machinery that includes computer program instructions capable, when executed, of causing a computer to carry out the steps of receiving, from an in-computer flame detector (252), on one of the blade servers (124) a flame event; sending an instruction to an in-computer fire extinguisher (254) in that blade server to release an extinguishing agent; and disabling the power supply to the blade server in which the flame was detected.

Also stored in RAM (168) is an operating system (154). Operating systems useful for in-computer fire suppression according to embodiments of the present invention include UNIX™, Linux™, Microsoft Windows XP™, Microsoft Vista™, AIX™, IBM's i5/OS™, and others as will occur to those of skill in the art. The operating system (154) and the fire suppression module (250) in the example of FIG. 2 are shown in RAM (168), but many components of such software typically are stored in non-volatile memory also, such as, for example, on a disk drive or in firmware (136) on an EEPROM drive, here shown as flash memory (134).

The exemplary blade management module (152) of FIG. 2 includes one or more input/output ('I/O') adapters (167). I/O adapters implement user-oriented input/output through, for example, software drivers and computer hardware for controlling output to display devices such as computer display screens, as well as user input from user input devices (181) such as keyboards and mice.

The exemplary blade management module (152) of FIG. 2 also includes a communications adapter (169) that couples the blade management module (152) internally within the blade environment (102) for data communications with blade servers (124) through a local area network (101). The networks (101) may be implemented, for example, as an Internet Protocol ('IP') network or an Ethernet™ network, an $I^2C$ network, a System Management Bus ('SMBus'), an Intelligent Platform Management Bus ('IPMB'), for example, and in other ways as will occur to those of skill in the art. Such a communications adapter (169) are electronic modules that implement the hardware level of data communications through which one computer sends data communications to another computer through a data communications network. Examples of communications adapters useful according to embodiments of the present invention include modems for wired dial-up communications, Ethernet (IEEE 802.3) adapters for wired data communications network communications, and 802.11 adapters for wireless data communications network communications.

The arrangement of the blade management module (152), the blade servers (124), and other devices making up the exemplary system illustrated in FIG. 2 are for explanation, not for limitation. Data processing systems useful according to various embodiments of the present invention for in-computer fire suppression may include additional servers, routers, and other devices, not shown in FIG. 2, as will occur to those of skill in the art. Networks in such data processing systems may support many data communications protocols, including for example TCP (Transmission Control Protocol), IP (Internet Protocol), HTTP (HyperText Transfer Protocol), WAP (Wireless Access Protocol), HDTP (Handheld Device Transport Protocol), and others as will occur to those of skill in the art. Various embodiments of the present invention may be implemented on a variety of hardware platforms in addition to those illustrated in FIG. 2.

Figure 3:
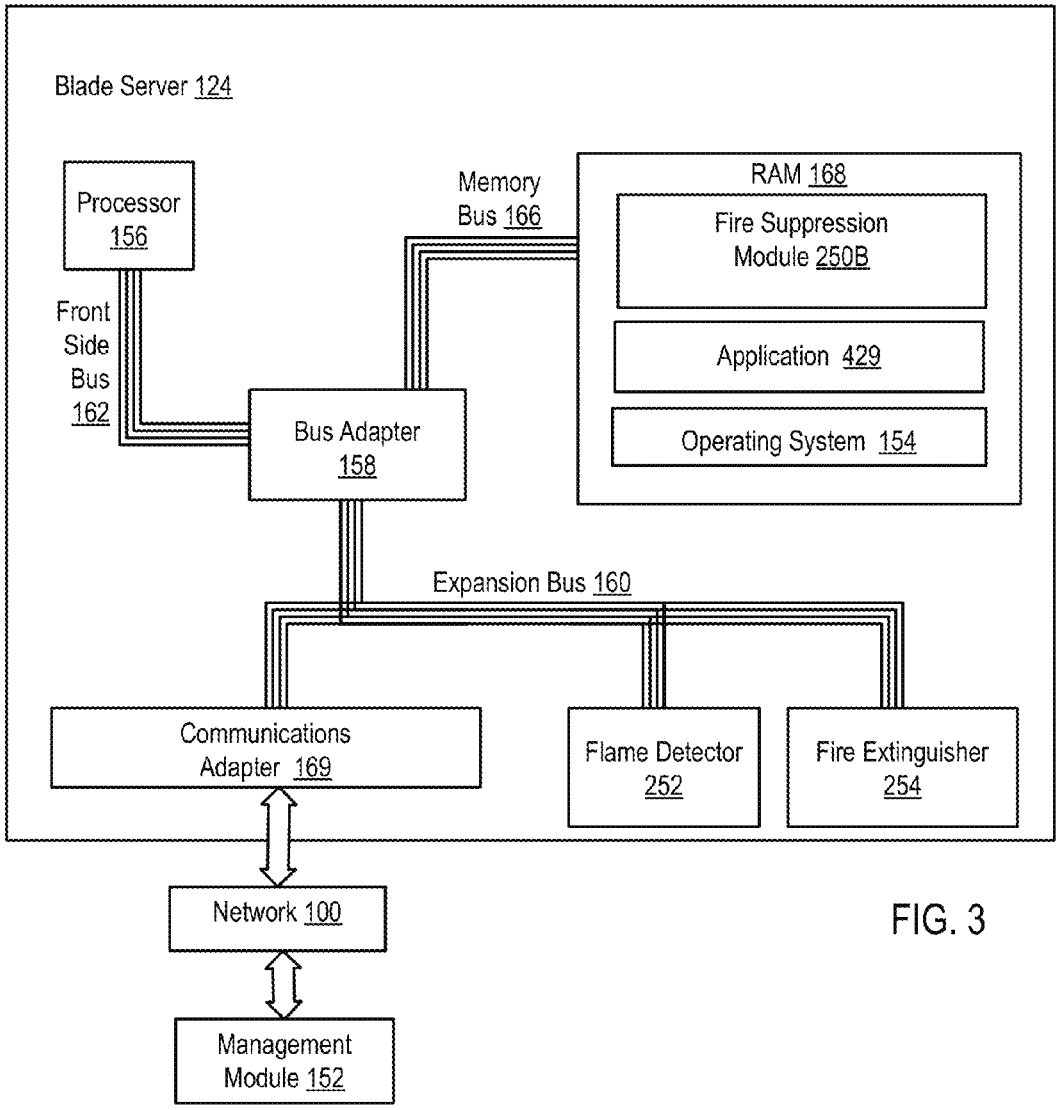
FIG. 3 sets forth a diagram of a further example data processing system capable of in-computer fire suppression according to embodiments of the present invention.

The examples of FIGS. 1 and 2 included a fires suppression module stored in a blade management module. In alternative embodiments, such a fire suppression module may be included in the computer in which the flame detector and the fire extinguisher are located. For further explanation, FIG. 3 sets forth a diagram of a further example data processing system capable of in-computer fire suppression according to embodiments of the present invention. The example data processing system of FIG. 3 is implemented as a blade server for use in a blade environment. The blade server (124) is connected through an internal LAN (101) to a blade management module (152). The blade server (124) of FIG. 1 includes at least one computer processor (156) or 'CPU' as well as random access memory (168) ('RAM').

Stored in RAM in this example is a fire suppression module (250B). The fire suppression module (25B) of FIG. 3 is a module of automated computing machinery that includes computer program instructions capable, when executed, of causing a computer to carry out the steps of receiving, from an in-computer flame detector (252), on one of the blade servers (124) a flame event; sending an instruction to an in-computer fire extinguisher (254) in that blade server to release an extinguishing agent; and disabling the power supply to the blade server in which the flame was detected.

Also stored in RAM (168) is an operating system (154) and an application (429) running on the operation system. Operating systems useful for in-computer fire suppression according to embodiments of the present invention include UNIX™, Linux™ Microsoft Windows XP™ Microsoft Vista™ AIX™ IBM's i5/OS™ and others as will occur to those of skill in the art. The operating system (154) and fire suppression module (250B) in the example of FIG. 3 are shown in RAM (168), but many components of such software typically are stored in non-volatile memory also, such as, for example, on a disk drive or in firmware (136) on an EEPROM drive, here shown as flash memory (134).

The exemplary blade server (124) of FIG. 3 also includes a communications adapter (169) that couples the blade server internally within the blade environment (102) for data communications with a blade management module (152) through a local area network (101). The networks (101) may be implemented, for example, as an Internet Protocol ('IP') network or an Ethernet™ network, an $I^2C$ network, a System Management Bus ('SMBus'), an Intelligent Platform Management Bus ('IPMB'), for example, and in other ways as will occur to those of skill in the art. Such a communications adapter (169) are electronic modules that implement the hardware level of data communications through which one computer sends data communications to another computer through a data communications network. Examples of communications adapters useful according to embodiments of the present invention include modems for wired dial-up communications, Ethernet (IEEE 802.3) adapters for wired data communications network communications, and 802.11 adapters for wireless data communications network communications.

The arrangement of the blade server and other devices making up the exemplary system illustrated in FIG. 3 are for explanation, not for limitation. Data processing systems useful according to various embodiments of the present invention for in-computer fire suppression may include additional servers, routers, and other devices, not shown in FIG. 3, as will occur to those of skill in the art. Networks in such data processing systems may support many data communications protocols, including for example TCP (Transmission Control Protocol), IP (Internet Protocol), HTTP (HyperText Transfer Protocol), WAP (Wireless Access Protocol), HDTP (Handheld Device Transport Protocol), and others as will occur to those of skill in the art. Various embodiments of the present invention may be implemented on a variety of hardware platforms in addition to those illustrated in FIG. 3.

Figure 4:
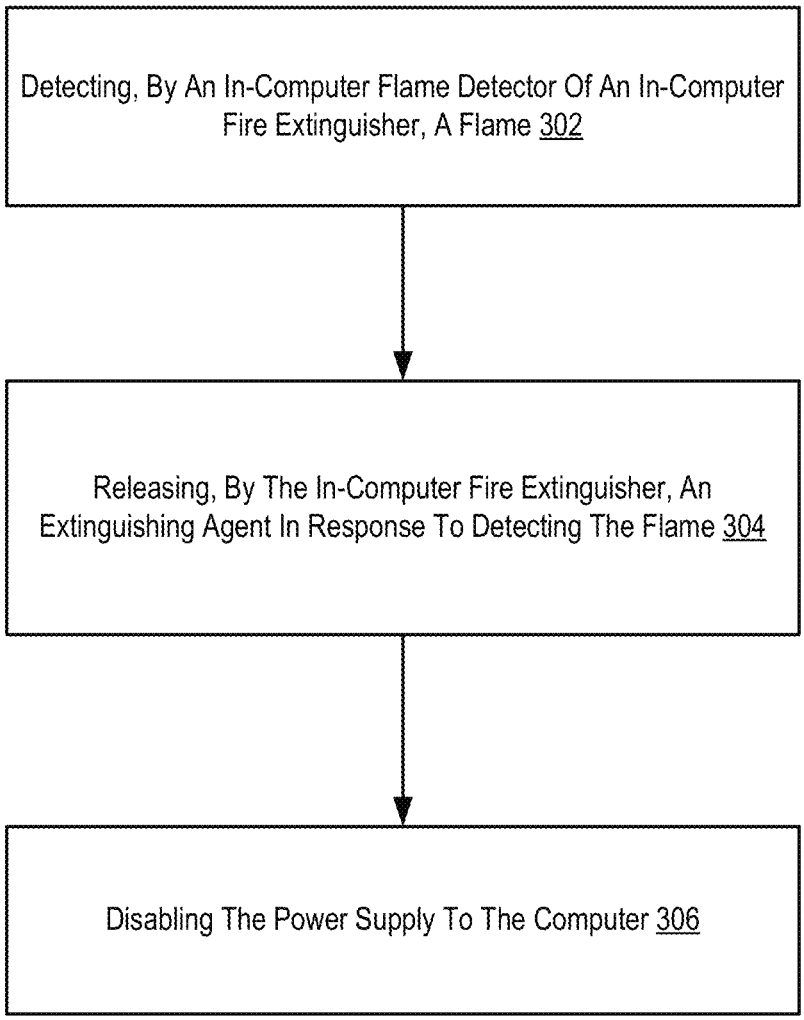
FIG. 4 sets forth a flow chart illustrating an exemplary method of in-computer fire suppression according to embodiments of the present invention.

For further explanation, FIG. 4 sets forth a flow chart illustrating an exemplary method of in-computer fire suppression according to embodiments of the present invention. The computer in the example of FIG. 4 includes an in-computer flame detector and an in-computer fire extinguisher. The method of FIG. 4 includes detecting (302), by an in-computer flame detector, a flame. As mentioned above, a flame detector is a sensor that detects flame. Flame detectors are typically optical sensors. There are a number of types of flame detectors useful for in-computer fire suppression according to embodiments of the present invention such as ultraviolet flame detectors, infrared flame detectors, combined ultraviolet-infrared flame detectors, dual infrared flame detectors, triple infrared flame detectors, visible radiation flame detectors and others as will occur to those of skill in the art.

The method of FIG. 4 also includes releasing (304), by the in-computer fire extinguisher, an extinguishing agent in response to the flame detector detecting the flame. As mentioned above, a fire extinguisher is a fire protection device used to extinguish or control fires. Fire extinguishers useful for in-computer fire suppression according to embodiments of the present invention may use different kinds of non-conductive extinguishing agents such as dry chemical, chemical foam, and others as will occur to those of skill in the art. Examples of extinguishing agents for in-computer fire suppression according to embodiments of the present invention include dry chemical extinguishing agents such as ammonium phosphate, sodium bicarbonate, potassium bicarbonate, potassium chloride, and others; foam extinguishing agents such as aqueous film forming foam, alcohol resistant aqueous film forming forms, film forming fluoroprotein, compressed air form, and others as will occur to those of skill in the art; carbon dioxide extinguishing agents; Halon extinguishing agents such as Halon 1211 and 1301, and others; FM-200-type agents; and other extinguishing agents as will occur to those of skill in the art.

The method of FIG. 4 also includes disabling (306) the power supply to the computer having within it the in-computer flame detector and the in-computer fire extinguisher. Disabling (306) the power supply to the computer having within it the in-computer flame detector and the in-computer fire extinguisher is typically carried out by disabling only that particular computer or one or more selected other computers that may be in close proximity to that computer, that is, not a chassis of computers. Disabling (306) the power supply to the computer having within it the in-computer flame detector and the in-computer fire extinguisher may be carried out by instructing a power management module to disable power to the blade server, by engaging a power supply disable pin, or in other ways as will occur to those of skill in the art.

Figure 5:
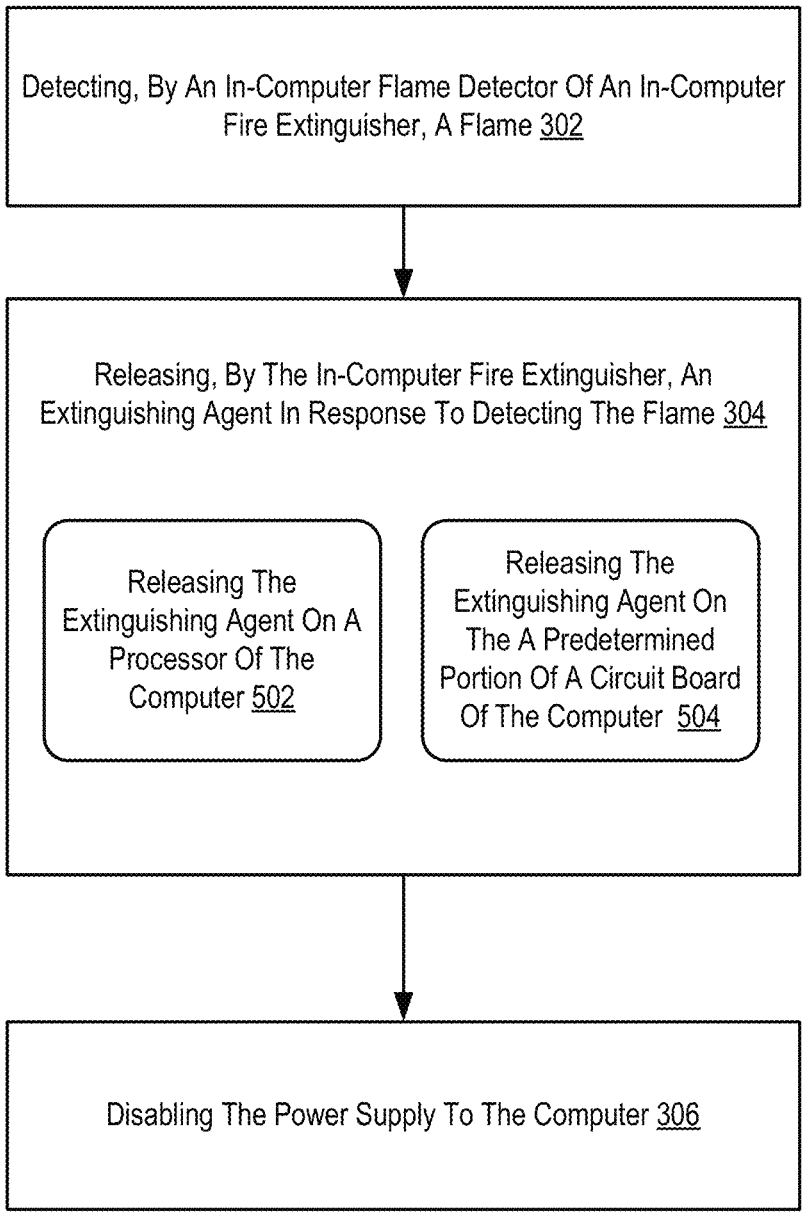
FIG. 5 sets forth a flow chart illustrating additional methods of in-computer fire suppression according to embodiments of the present invention.

For further explanation, FIG. 5 sets forth a flow chart illustrating methods of in-computer fire suppression according to embodiments of the present invention. The method of FIG. 5 is similar to the method of FIG. 4 in that the method of FIG. 5 includes detecting (302), by an in-computer flame detector, a flame, releasing (304), by the in-computer fire extinguisher, an extinguishing agent in response to the flame detector detecting the flame and disabling (306) the power supply to the computer having within it the in-computer flame detector and the in-computer fire extinguisher.

The method of FIG. 5 also includes two alternative methods of releasing (304), by the in-computer fire extinguisher, an extinguishing agent in response to detecting the flame. Releasing (304), by the in-computer fire extinguisher, an extinguishing agent in response to detecting the flame according to the example of FIG. 5 may be carried out by releasing (502) the extinguishing agent on a processor of the computer. In such embodiments, the fire extinguisher is oriented toward one or more processors of the computer. Such an orientation may be useful for servers that are running computationally intensive applications.

Releasing (304), by the in-computer fire extinguisher, an extinguishing agent in response to detecting the flame according to the example of FIG. 5 also may be carried out by releasing (504) the extinguishing agent on the a predetermined portion of a circuit board of the computer. In such embodiments, the fire extinguisher is oriented toward portions of the circuit board previously determined to be susceptible to fires.

Figure 6:
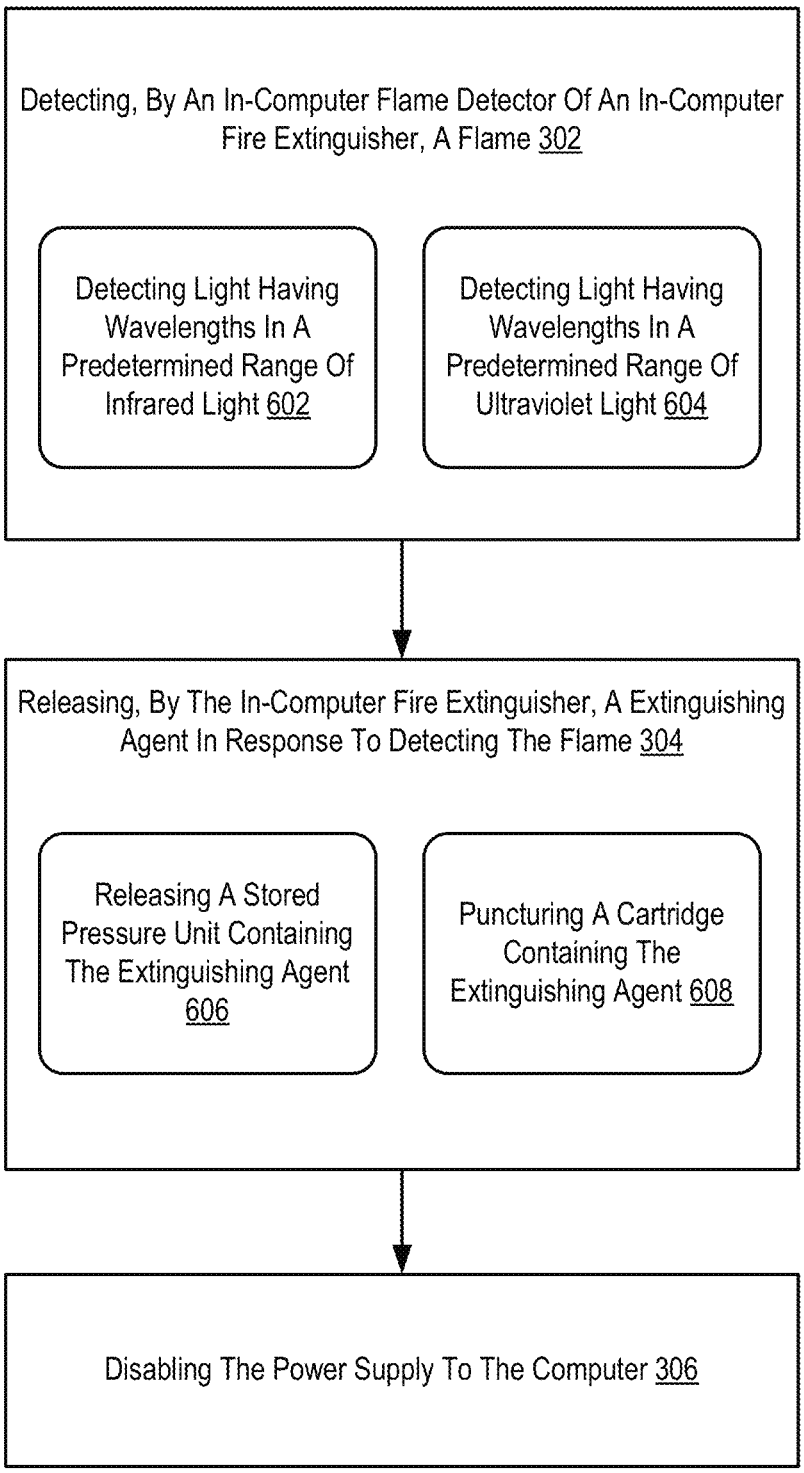
FIG. 6 sets forth a flow chart illustrating additional methods of in-computer fire suppression according to embodiments of the present invention.

For further explanation, FIG. 6 sets forth a flow chart illustrating methods of in-computer fire suppression according to embodiments of the present invention. The method of FIG. 6 is similar to the method of FIG. 4 in that the method of FIG. 6 includes detecting (302), by an in-computer flame detector, a flame, releasing (304), by the in-computer fire extinguisher, an extinguishing agent in response to the flame detector detecting the flame and disabling (306) the power supply to the computer having within it the in-computer flame detector and the in-computer fire extinguisher.

The method of FIG. 6 however illustrates two alternative methods of detecting (302), by an in-computer flame detector of an in-computer fire extinguisher, a flame and releasing (304), by the in-computer fire extinguisher, an extinguishing agent in response to detecting the flame. Detecting (302), by an in-computer flame detector of an in-computer fire extinguisher, a flame according to the example of FIG. 6 includes detecting (602) light having wavelengths in a predetermined range of infrared light. Detecting (602) light having wavelengths in a predetermined range of infrared light may be carried out with an optical infrared flame detector.

Detecting (302), by an in-computer flame detector of an in-computer fire extinguisher, a flame further according to the example of FIG. 6 also may be carried out by detecting (604) light having wavelengths in a predetermined range of ultraviolet light. Detecting (604) light having wavelengths in a predetermined range of ultraviolet light may be carried out with an optical ultraviolet flame detector.

Releasing (304), by the in-computer fire extinguisher, an extinguishing agent in response to detecting the flame according to the example of FIG. 6 may be carried out by releasing (606) a stored pressure unit containing the extinguishing agent. As mentioned above, in stored pressure units, an expellant is stored in the same chamber as the extinguishing agent itself. Depending on the agent used, different propellants are used. With dry chemical extinguishers, nitrogen is often used; water and foam extinguishers typically use air.

Releasing (304), by the in-computer fire extinguisher, an extinguishing agent in response to detecting the flame according to the example of FIG. 6 also includes puncturing (608) a cartridge containing the extinguishing agent. As mentioned above, cartridge-operated fire extinguishers contain an expellant gas in a separate cartridge that is punctured prior to discharge, exposing the propellant to the extinguishing agent.

Cartridge-operated extinguishers often use compressed carbon dioxide instead of nitrogen.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, apparatuses, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

It will be understood from the foregoing description that modifications and changes may be made in various embodiments of the present invention without departing from its true spirit. The descriptions in this specification are for purposes of illustration only and are not to be construed in a limiting sense. The scope of the present invention is limited only by the language of the following claims.

What is claimed is:

1. A method of in-computer fire suppression, a computer comprising an in-computer flame detector and an in-computer fire extinguisher, the method comprising:

detecting, by the in-computer flame detector located within an enclosure of the computer, a flame; and releasing, by the in-computer fire extinguisher located within the enclosure of the computer, an extinguishing agent in response to the flame detector detecting the flame, including releasing the extinguishing agent on a processor of the computer.

2. The method of claim 1 further comprising disabling the power supply to the computer having within it the in-computer flame detector and the in-computer fire extinguisher.

3. The method of claim 1 wherein the extinguishing agent further comprises carbon dioxide.

4. The method of claim 1 wherein the extinguishing agent further comprises Halon.

5. The method of claim 1 wherein releasing, by the in-computer fire extinguisher, an extinguishing agent in response to detecting the flame further comprises releasing the extinguishing agent on a predetermined portion of a circuit board of the computer.

6. The method of claim 1 wherein detecting, by an in-computer flame detector of an in-computer fire extinguisher, a flame further comprises detecting light having wavelengths in a predetermined range of infrared light.

7. The method of claim 1 wherein detecting, by an in-computer flame detector of an in-computer fire extinguisher, a flame further comprises detecting light having wavelengths in a predetermined range of ultraviolet light.

8. The method of claim 1 wherein releasing, by the in-computer fire extinguisher, an extinguishing agent in response to detecting the flame further comprises releasing a stored pressure unit containing the extinguishing agent.

9. The method of claim 1 wherein releasing, by the in-computer fire extinguisher, an extinguishing agent in response to detecting the flame further comprises puncturing a cartridge containing the extinguishing agent.

* * * * *